US011162032B2

(12) United States Patent
Donegan

(10) Patent No.: US 11,162,032 B2
(45) **Date of Patent: *Nov. 2, 2021**

(54) PYROLYSIS OR GASIFICATION APPARATUS AND METHOD

(71) Applicant: STANDARD GAS LIMITED, London (GB)

(72) Inventor: Daniel Michael Donegan, Essex (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/933,561

(22) Filed: Jul. 20, 2020

(65) Prior Publication Data

US 2020/0407644 A1 Dec. 31, 2020

Related U.S. Application Data

(63) Continuation of application No. 16/567,979, filed on Sep. 11, 2019, now Pat. No. 10,808,178, which is a (Continued)

(30) Foreign Application Priority Data

Mar. 5, 2015 (GB) ..... 1503760

(51) Int. Cl.
*C10B 57/18* (2006.01)
*C10J 3/74* (2006.01)
(Continued)

(52) U.S. Cl.
CPC ..... *C10B 57/18* (2013.01); *C10B 1/04* (2013.01); *C10B 21/00* (2013.01); *C10B 21/18* (2013.01);
(Continued)

(58) Field of Classification Search
CPC ..... C10B 1/04; C10B 49/08; C10B 53/00; C10B 53/07; C10B 21/00; C10B 21/18; C10B 47/22; C10B 49/12; C10B 49/16; C10B 53/02; C10B 57/18; C10G 1/02; C10G 1/00; C10G 1/006; C10G 1/10;
(Continued)

(56) References Cited

U.S. PATENT DOCUMENTS 4,101,263 A 7/1978 Lumpkin, Jr.
4,225,392 A 9/1980 Taylor
(Continued)

FOREIGN PATENT DOCUMENTS

CN 201553705 8/2010
CN 101906323 12/2010
(Continued)

OTHER PUBLICATIONS

International Search Report and Written Opinion of the European Patent Office International Search Authority for International application No. PCT/GB2016/050584 dated Jul. 19, 2016.
(Continued)

*Primary Examiner* — Sharon Pregler
(74) *Attorney, Agent, or Firm* — Procopio, Cory, Hargreaves & Savitch LLP

(57) ABSTRACT

A pyrolysis apparatus having a heating system adapted to heat a first gas enclosure, wherein a gas path within the heated enclosure is helical or spherical. Pyrolysis is used to destroy oils, tars and/or PAHs in a gaseous mixture.

16 Claims, 6 Drawing Sheets

Related U.S. Application Data continuation of application No. 15/554,683, filed as application No. PCT/GB2016/050584 on Mar. 4, 2016, now abandoned.

(51) Int. Cl.

| | |
|---|---|
| ***C10J 3/48*** | (2006.01) |
| ***C10B 1/04*** | (2006.01) |
| ***C10B 21/00*** | (2006.01) |
| ***C10B 21/18*** | (2006.01) |
| ***C10G 1/02*** | (2006.01) |
| ***C10G 9/00*** | (2006.01) |

(52) U.S. Cl.
CPC ..... *C10G 1/02* (2013.01); *C10G 9/00* (2013.01); *C10J 3/487* (2013.01); *C10J 3/74* (2013.01); *C10J 2300/1246* (2013.01)

(58) Field of Classification Search
CPC ..... C10G 2300/1011; C10G 2300/701; C10G 2300/807; C10G 2/32; C10G 2/342; C10G 9/00
See application file for complete search history.

(56) References Cited

U.S. PATENT DOCUMENTS 5,770,017 A * 6/1998 Brown ..... C10B 53/00 201/25
2011/0168605 A1 7/2011 Blevins et al.

FOREIGN PATENT DOCUMENTS

| | | |
|---|---|---|
| CN | 202047039 | 11/2011 |
| CN | 2030079920 | 7/2013 |
| CN | 103305244 | 9/2013 |
| EP | 3093271 A1 | 11/2016 |
| GB | 825841 | 12/1959 |

OTHER PUBLICATIONS

UKIPO Search Report under Section 17(5) for UK application GB1503760.9 dated Aug. 17, 2016.
UKIPO Examination Report under Section 18(3) for UK application GB1503760.9 dated Oct. 17, 2016.
UKIPO Examination Report under Section 18(3) for UK application GB1503760.9 dated Jun. 1, 2017.

* cited by examiner

PYROLYSIS OR GASIFICATION APPARATUS AND METHOD

CROSS REFERENCES TO RELATED APPLICATIONS

This application is a continuation of U.S. patent application Ser. No. 16/567,979 filed Sep. 11, 2019, which is a continuation of U.S. patent application Ser. No. 15/554,683 filed Aug. 30, 2017, which is a United States National Phase Application of PCT/GB2016/050584 filed Mar. 4, 2016, and claims priority to United Kingdom Patent Application No. 1503760.9 filed Mar. 5, 2015, all of which are incorporated by reference herein.

FIELD OF DISCLOSURE

The present invention generally relates to pyrolysis and gasification methods and apparatus. Pyrolysis is used to destroy calorific waste and/or to produce gas therefrom. The destruction of calorific waste is desirable to avoid the need for environmental damage due to burial in landfill sites, or dumping at sea. However, some forms of destruction create gaseous pollution and/or carbon dioxide, leading to environmental damage and potentially increasing global warming. Additional processing is therefore required before the gas can be used.

BACKGROUND

Advanced Thermal Treatment (ATT) primarily relates to technologies that employ pyrolysis or gasification. ATT is discussed in the Brief, entitled 'Advanced thermal treatment of municipal solid waste' produced by the Department for Environment, Food & Rural Affairs of the UK Government (https://www.gov.uk/government/publications/advanced-thermal-treatment-of-municipal-solid-waste). That Brief indicates a problem with conventional pyrolysis and gasification systems is tarring, in which the build up of tar can cause operational problems (for example, if tar build up causes blockages).

Pure pyrolysis is a process of thermochemical decomposition of material to produce gas, in which oxygen is absent. If a small quantity of oxygen is present, the production of gas is termed gasification. The amount of oxygen present in gasification is insufficient to allow combustion to occur. In the present application, unless otherwise specified, pyrolysis and gasification will have the same meaning.

In an ATT process, gas is released from a feed material or 'feedstock', leaving solid matter (char) as a by-product. The skilled person will understand that the term 'feedstock' as used throughout this description relates to any solid material having a calorific value. Feedstocks typically envisaged in this context are waste materials such as biomass, wood or paper, rubber tyres, plastics and polythene, or sewage solids. They also include low quality fossil fuels such as lignite or bituminous coals. The feedstock of ATT units for generating syngas may be most carbon-based materials with a calorific value. For example, fossil fuels can be used. However, in conventional ATT units, the feedstock must be prepared before entering the unit, thus adding additional time and expense to the process.

Conventionally, part of the preparation process includes drying the feedstock, as water may cool the ATT unit, thereby reducing the efficiency of the ATT process and increasing the amount of tars, oils and PAHs in the resulting gas. Moreover, in preparing the feedstock, certain material with a calorific value may be rejected as being non-compliant with a given ATT unit. For example, certain feedstock materials may be difficult for some fuel specific ATT technologies to breakdown using thermal processes.

The released gas, termed synthetic gas or "syngas" hereafter, can then be used as a fuel to generate heat or electricity either on the spot or elsewhere. If carbonaceous material is used as the feedstock, the resulting solid residue ("char") is generally richer in carbon. That char also may be used as a secondary fuel source. Generally, conventional pyrolysis processes do not result in syngas pure enough to be input into a generator. Instead, the syngas must first be put through a rigorous cleaning (scrubbed) process, so that any remaining particulate matter and tar are removed from the syngas. The retention of tar and oil is the consequence of insufficient temperature and dwell time.

Those oils and tars can contain polycyclic aromatic hydrocarbons, PAHs, (also termed poly-aromatic hydrocarbons), which are organic pollutants that may be formed from incomplete combustion of carbonaceous material (such as wood, coal, oil etc). PAHs can be hazardous to human health, and can have toxic and/or carcinogenic properties. It is therefore preferable that gas exiting the pyrolysis system is free from oils and tars, and therefore from PAHs.

PAHs usually have high melting points and boiling points. The boiling points may, for example, be 500° C. or more. For example, Picene ($C_{22}H_{14}$) has a boiling point of around 520° C. and a melting point of around 365° C. and Coronene ($C_{24}H_{12}$) has a boiling point of around 525° C. and a melting point of around 440° C. Accordingly, thermochemical decomposition, or 'cracking', PAHs requires very high temperatures and the PAHs are difficult to remove using a conventional pyrolysis process.

In some variants, a pyrolysis system includes a rotary retort in which the pyrolysis process takes place. The rotation of the retort helps to mechanically break up the feedstock. In order to provide adequate structural strength conventional rotary retorts may be made of materials such as steel or nickel alloy. Such materials are not particularly efficient thermal conductors, meaning that a large portion of the energy used to heat the rotary retort is not transferred to the feedstock and/or gas within the retort. It is difficult, therefore, to raise the temperature of inside of the retort to a level sufficient to fully crack the PAHs. The syngas exiting a conventional retort therefore contains particulate tars and oils, including the PAHs. Whilst the dwell time within the retort can be increased to crack the PAHs, this reduces the throughput of feedstock and therefore reduces the efficiency of the pyrolysis system.

WO2005/116524 describes plant equipment which includes two gasifiers. Char from the primary gasifier is used as fuel in the secondary gasifier. The primary gasifier is a rotary kiln consisting of a rotating, slightly inclined metal shell or tube which transports fuel along its length. The exhaust gas from the secondary gasifier external to the kiln heats the tube.

WO2005/116524 further describes an apparatus and process for converting carbonaceous or other material with calorific value into high quality gas preferably to fuel a reciprocating gas engine for the generation of electricity. Wet fuel enters the unit, whereupon it is dried. The dried fuel then is checked for size via a trammel. Correctly sized fuel passes through the trammel and oversized fuel goes onto the reject conveyer where it is delivered for shredding, after which the fuel may be correctly sized. The correctly sized dry fuel is then compacted forming a cylindrical fuel plug, to minimise the amount of air, and fed via a feed system into a gasifier provided with an internal vane configuration, which allows homogenous distribution of the feed material over a large area of a retort. The gas released by the arrangement WO2005/116524 is cooled and cleaned in a gas quench unit.

One issue with many conventional ATT systems is the inability to completely crack, or breakdown, some materials. The syngas exiting those ATT systems therefore contains residual particulates, such as tars and oils, that must be removed from the syngas before the syngas can be used.

It is known in the art that use of a $CO_2$ atmosphere may improve the yield of syngas produced from a pyrolysis process. "An Investigation into the Syngas Production From Municipal Solid Waste (MSW) Gasification Under Various Pressure and CO2 Concentration" (Kwon et al, presented at the 17th Annual North American Waste-to-Energy Conference 18-20 May 2009, Chantilly, Va., US, Proc 17th Annual North American Waste-to-Energy Conference NAWTEC17, paper NAWTEC17-2351) discloses that CO2 injection enables further char reduction, and produces a significantly higher proportion of CO. Additionally, CO2 injection reduces the levels of Polycyclic Aromatic Hydrocarbons (PAHs), which can be directly related to tar and coke formation during a gasification process.

Means for Solving the Problem

The inventors have devised novel and inventive Advanced Thermal Treatment (pyrolysis and gasification) apparatuses and methods. A broad description will be given of specific aspects of the invention. Preferred features of the specific aspects are set out in the dependent claims.

In accordance with the present invention, there is provided a pyrolysis apparatus having a heating system adapted to heat a gas enclosure, wherein a gas path within the heated enclosure is helical or spherical. In accordance with the present invention, there is also provided a method of cracking hydrocarbons comprising heating a gaseous mixture, containing hydrocarbons, that is travelling around an axis of the gas enclosure.

A helical or spherical gas path enables heavier particulates within a gas to be impelled toward the wall of the gas enclosure. When the gas enclosure is heated, the heavier particulates move closer to the heated wall of the gas enclosure, thereby experiencing a greater heat transfer. Some of the heavier particulates will move into physical contact with the heated wall of the gas enclosure, thereby experiencing conductive heat transfer. Heavier particulates are therefore more easily broken down. For example, when the gaseous mixture is syngas mixed with oils, tars and/or PAHs, the syngas oils, tars and/or PAHs, being heavier, will be impelled toward the heated wall of the gas enclosure. Accordingly, syngas produced by the method requires a reduced amount of cleaning.

In some aspects, the gas enclosure is a tube having a spiral insert. This minimises the space required to centrifuge the gaseous mixture. The tube having a spiral insert may replace that already exists, and is already in a location where it will be heated, within a pyrolysis or gasification (ATT) apparatus.

In some aspects, the gas enclosure includes a frustoconical shell having a gas input pipe connected thereto, the input pipe being inclined at a radius of the gas enclosure. Advantageously, the heavier particles are impelled toward the wall of the gas enclosure by the centripetal force and gravity. Further, heavy particulates that cannot be broken down can be readily removed. In some aspects, the gas enclosure includes an extension portion having parallel, or substantially parallel, walls extending from a widest circumference of the frustoconical shell. The extension portion is simpler to manufacture than the frustoconical shell, and can increase the dwell time within the gas enclosure. In some aspects, the frustoconical shell has a smaller diameter end positioned below a larger diameter end. Heavy particulates that cannot be broken down can accumulate at the smaller diameter for ease of removal.

In some aspects, wherein the gas enclosure is a coiled tube.

In some aspects, the apparatus comprises a pyrolysis unit having pyrolysis region and a gas exit passage, wherein the gas enclosure is coupled to the gas exit passage. Gas from the pyrolysis region may therefore enter the gas enclosure. The gas retains some of the heat applied during a pyrolysis process in the pyrolysis region, thereby improving the efficiency of the pyrolysis apparatus.

In some aspects, the heating system is adapted to heat the pyrolysis region. Including a heating system that heats both the gas enclosure and the pyrolysis region improves the efficiency of the pyrolysis system. In some aspects, the gas enclosure is located within the heating system. The gas enclosure is therefore located in a hotter location than the pyrolysis region, meaning that particulates that remain within a gaseous mixture that results from a pyrolysis process in the pyrolysis region are more likely to be cracked in the gas enclosure.

In some aspects, the pyrolysis apparatus comprises a second gas enclosure, wherein a gas path within the second heated enclosure is helical or spherical and a gas output of the first gas enclosure is connected to a gas input of the second gas enclosure. Including more than one gas enclosure having a helical or spherical gas path increases the dwell time of the gaseous mixture. Additionally, heat transfer to the heavier particulates will be conductive for longer.

In some aspects, the heating system comprises a thermally insulated chamber and one or more heat sources arranged to heat the inside of the thermally insulated chamber.

In some aspects, the heating system comprises a plurality of heating units, wherein each heating unit comprises a thermally insulated chamber and a heat source arranged to heat the inside of the thermally insulated chamber. Temperature of gas enclosures within each of the heating systems can therefore be controlled separately.

In some aspects, the gas enclosure is within the thermally insulated chamber.

In some aspects, the thermally insulated chamber has an exit aperture through one wall, and the gas enclosure is positioned between the heat source and the exit aperture. Heated air from the heat source will directly impinge on the gas enclosure before leaving the thermally insulated chamber.

In some aspects, the heating system is adapted to heat an exterior surface of the gas enclosure.

In some aspects, the gaseous mixture follows a spiral or helical path about said axis. Following a spiral or helical gas path about an axis ensures particulates are in contact with the heated wall of a gas enclosure for a prolonged period of time.

Some aspects comprise pyrolysing a feedstock to create the gaseous mixture.

Some aspects comprise using a single heating system to pyrolyse the feedstock and to heat said gaseous mixture.

Advantageously, the present invention can reduce the scrubbing (cleaning) required to produce usable syngas.

BRIEF DESCRIPTION OF THE DRAWINGS

Various embodiments and aspects of the present invention are described without limitation below, with reference to the accompanying figures in which.

DETAILED DESCRIPTION OF A PREFERRED EMBODIMENT

Figure 1:
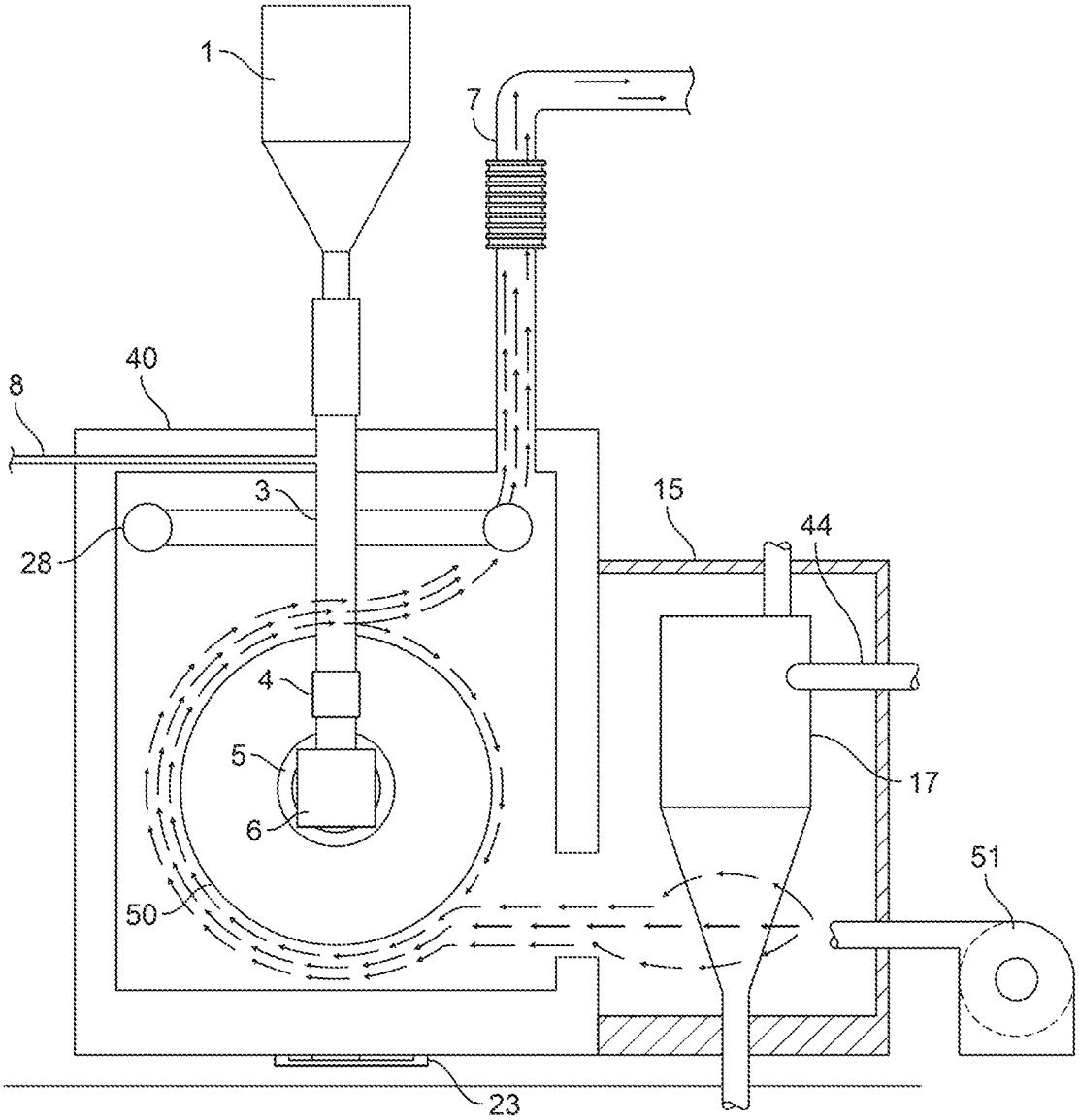
FIG. 1 is a sectional end elevation of a pyrolysis apparatus according to an embodiment.

The following description relates to Advanced Thermal Treatment (ATT) of feedstock. Specific examples of ATT include pyrolysis and gasification. In the present application, unless otherwise specified, pyrolysis and gasification will have the same meaning. Further, it will be understood that the description of an ATT apparatus may equally relate to a gasification apparatus or a pyrolysis apparatus. Similarly, the description of an ATT method or process may equally relate to a gasification method or process, or a pyrolysis method or process.

The present invention generally relates to the use of a spiral or helical gas path within a heated enclosure (gas enclosure) to pyrolyse or gasify a gaseous mixture following that gas path. For the purposes of this document, the terms 'helix' and 'helical' are used to denote a helix or a spiral unless otherwise specified. The heated enclosure could be a heated pipe, tube or system of piping, or a heated cone.

The heated enclosure (gas enclosure) 17 containing a helical gas path is particularly of use for processing a gaseous mixture that results from an ATT process in an ATT unit 50. If that ATT process is not efficient, the gaseous mixture may contain tars, oils and PAHs in addition to syngas. That gaseous mixture can be directed through the heated enclosure 17, in which hydrocarbons are cracked. Within the heated enclosure 17, the gaseous mixture is forced into a spiral or helical path, thereby giving rise to a centrifugal force.

The magnitude of centrifugal force is given by the following equation:

$$F = \frac{mv^2}{r}$$

where F is the centrifugal force, m is the mass of a particle, v is the tangential velocity of the particle, and r is the radius of curvature.

It will be appreciated that the particles of tars, oils and PAHs will be more massive than the syngas particles. As shown by the above equation, those more massive particles experience a greater centrifugal force, are more likely to be moved into contact with the wall of the enclosure, whereupon they experience conductive heat transfer from the hottest portion of the enclosure. As conductive heat transfer is more efficient than convective or radiative heat transfer, the particles in contact with the enclosure wall are more likely to be pyrolysed that particles more remote from the enclosure wall. Additionally, the centrifugal force keeps the heavier particles in contact with the enclosure wall, thereby increasing the length of time in which the heavier particles experience conductive heating. Even where particles merely approach, and do not contact, the wall, there will be a temperature profile such that the zone closer to the wall will be hotter, so that in general, the heavier (and more in need of cracking) the particles are, the more heat they are exposed to. By centrifuging the gaseous mixture in this manner, the heavier particles within the gas are more likely to be broken down (i.e. cracked or pyrolysed), and therefore fewer particulates remain in the gaseous mixture.

The enclosure wall may be heated by any mechanism that achieves a temperature sufficient for an ATT process. In the preferred embodiment, for example, a burner blows heated air onto the enclosure wall.

Some implementations of the above concept are described below.

Frustoconical Shell

Figure 3:
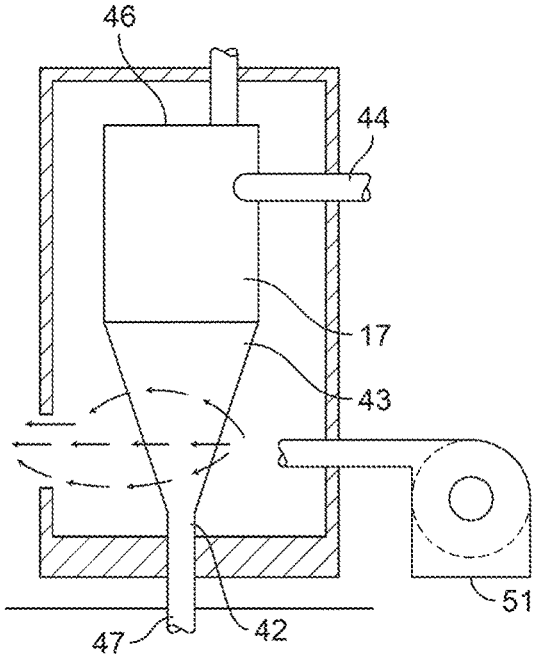
FIG. 3 is a section side elevation of a heating system including a gas enclosure of a preferred embodiment.

In a preferred embodiment, as shown in FIG. 3, the heated enclosure (gas enclosure) 17 includes a frustoconical shell 41 with a first opening 42 having a first radius being positioned lower a second opening 43 having a second radius, with the first radius being smaller than the second radius. Gas is inserted into the frustoconical shell 41 at an oblique angle to the diameter of the shell. The gas therefore spirals within the shell (i.e. the gas generally follows a helical path) 41, and the particles within the gas experience centrifugal force, which causes those particles to move away from the axis and toward the wall of the frustoconical shell 41.

Figure 4A:
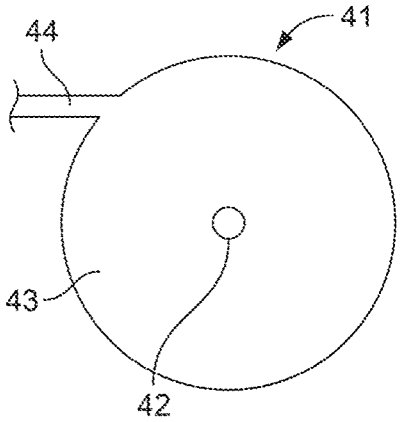
FIGS. 4*a-c* show plan views of various aspects of the preferred embodiment.
Figure 4B:
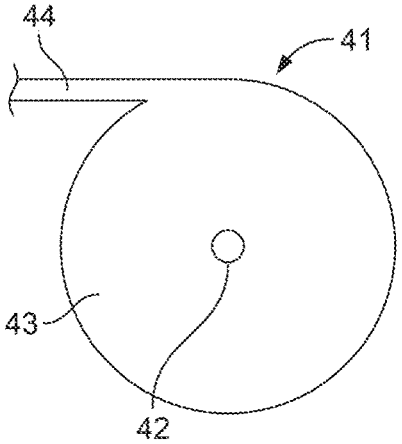
Figure 4C:
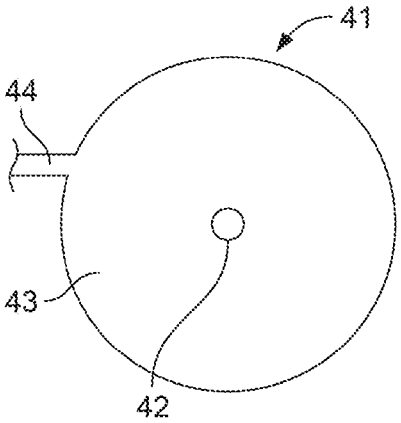
Figure 5A:
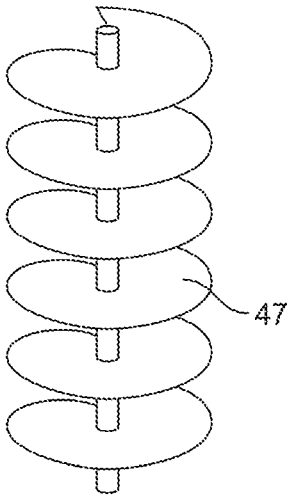
FIG. 5*a* shows a perspective view of a spiral insert
Figure 5B:
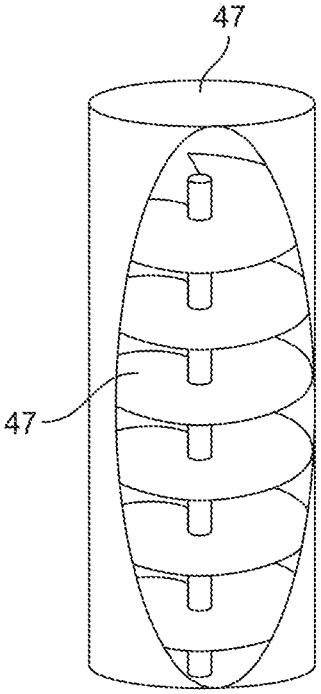
FIG. 5*b* shows a perspective view of a tube having a cut-away showing the spiral insert of FIG. 5*a*.

The gas may enter the heated enclosure (gas enclosure) 17 in any manner, as shown in FIGS. 4*a-c*, as long as the gas enters the heated enclosure 17 at an angle inclined to a radius of the heated enclosure 17. In other words, if the frustoconical axis 41 is aligned with a Z-axis, gas enters the frustoconical shell 41 at an oblique angle when considering only the X and Y components. This does not limit the Z-component of the gas entry angle. For example, gas may enter the frustoconical shell 41 by a pipe 44 that is attached to the shell 41, such that gas is not directed directly toward the axis of the frustoconical shell 41. As the gas is not directed along a radial line of the heated enclosure 17, it is caused to follow a gas path about an axis of that heated enclosure 17, thereby giving rise to a centrifugal force.

In some variations of this aspect, an extension portion 46 extends from the widest circumference of a frustoconical portion. The extension portion 46 has parallel, or substantially parallel, walls. It will be appreciated that the cross section of the extension portion 46 will be the same as the cross section of the second opening 43. In the example shown in FIG. 3, the gas obliquely enters the extension portion 46 above the frustoconical portion.

The gas initially follows a spiral path in the extension portion 46. Heavier particulates in the gas fall, under gravity, into the frustoconical portion, whereas hot gas generally rises through the extension portion 46 to exit the enclosure through the exit aperture.

As the heavier particulates fall through the frustoconical portion, gravity and the centrifugal force impel those particulates toward the wall of the frustoconical portion. The time spent in contact with the heated enclosure wall is therefore increased for the heavier particulates, which require the most energy to breakdown. Heavy particulates that are not broken down by in the frustoconical portion fall through the waste aperture 47 at the bottom of the enclosure, thereby preventing build up of unwanted residual particulates within a piping system. This reduces the chances of blockages within a piping system and reducing the amount of cleaning and scrubbing required for syngas exiting the pyrolysis apparatus.

In the arrangement shown in FIG. 3, a frustoconical shell is included as part of a heating system, which comprises a thermally insulated chamber 15 and a heat source 51 provided to heat the inside of the thermally insulated chamber 15. For example, an ATT unit in an ATT apparatus is heated by an external heating system 52, with an external heating system 52 comprising at least one heating unit. In some aspects, a heating system 52 comprises three heating units.

In FIGS. 3 and 4*a-c*, the frustoconical shell 41 is shown as having a circular cross-section. It will be appreciated, however, that other cross-sections, such as an oval or an ellipse, could also be adopted as long as the cross-section includes a surface that causes gas to flow around an axis of curvature. Sharp corners are preferably avoided to minimise turbulence in the gas path.

Heated Tube with a Spiral Insert

In another aspect, as shown in FIGS. 4*a* and 4*b*, the heated enclosure (gas enclosure) 17 is a tube (or pipe) 48, and the helical gas path may be created by spiral insert 49 within the tube 48. Preferably, the spiral insert 49 is fixedly attached to the inside of the tube 48 such that the spiral insert 49 does not rotate with respect to the tube 48.

The gas cannot flow along the centre of the centre of the tube 48 due to the spiral insert 49 and instead flows in a helical path. Under the centrifugal force, the particles within the gas move toward the tube wall. The particles with greater mass (i.e. the more massive particles) experience a larger centrifugal force than the particles with a lesser mass. The more massive particles are therefore more likely to come into physical contact with the tube wall, and experience a conductive heat transfer.

The edge of the spiral insert 49 may be connected to the enclosure wall, thereby placing the spiral insert 49 in conductive thermal contact with the enclosure wall. In this arrangement, the spiral insert will be heated by conduction with the tube wall, and can assist in conductive heat transfer to the particles within the gas.

The spiral insert 49 may be located within a tube (or pipe) 49 downstream, in the gas path, of the retort 50 in an ATT apparatus, in which the tube 49 and the retort 50 are heated by the same heat source 51. In such an arrangement, the tube 49 and the retort 50 are preferably located within the same thermally insulated housing 40. This makes efficient use of a heat source 51 for a pyrolysis retort. Alternatively, the tube 49 may be placed within a thermally insulated chamber separate from the thermally insulated housing. The tube 49 may also be used in place of the frustoconical shell of the preferred embodiment.

Coiled Tube

In an aspect, the enclosure is a coiled tube (coiled pipe). The gas is caused to flow around the coiled tube, thereby flowing in a spiral path. Heavier particles are urged towards the wall portion on the outside of the spiral. In some embodiments, the coiled tube may be used in place of the frustoconical shell of the preferred embodiment. Alternatively, the gas coil can be located downstream, in the gas path, of the retort 50 in an ATT apparatus.

Serial Gas Enclosures

Figure 6A:
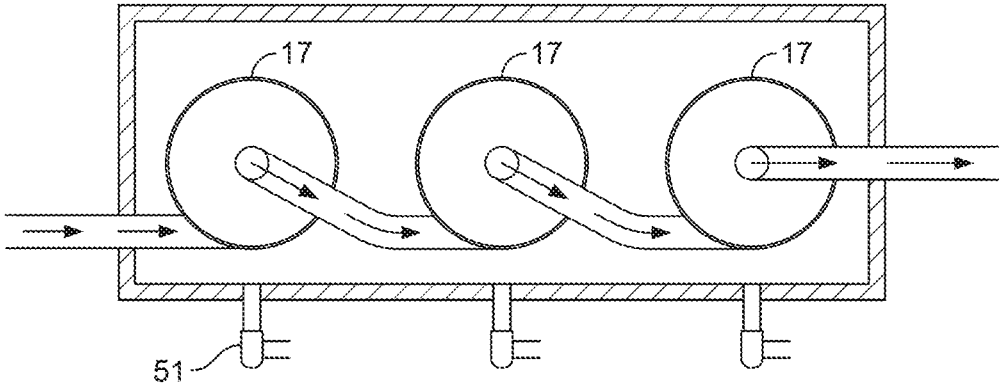
FIG. 6*a* shows a plan view of a series of gas enclosures within a thermally insulated chamber.
Figure 6B:
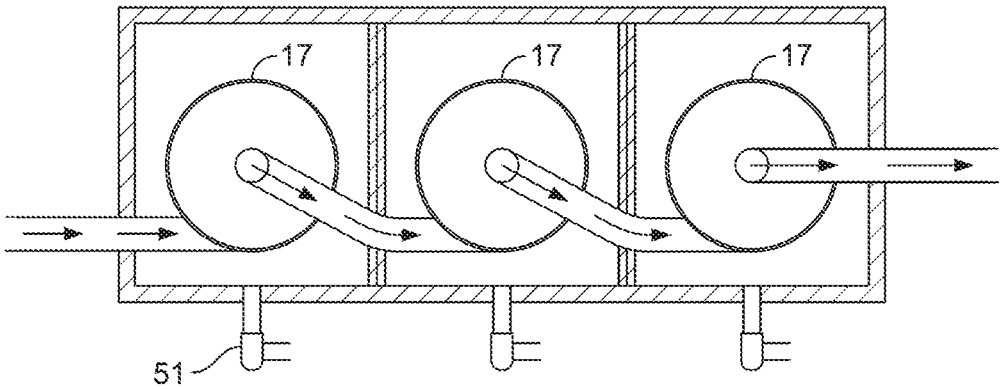
FIG. 6*b* shows a plan view of a series of gas enclosures each with a respective thermally insulated chamber.

FIGS. 6*a* and 6*b* show aspects in which three gas enclosures 17 are provided in series. It will be appreciated that more gas enclosures 17 may be added, or two gas enclosures 17 may be used, as long as there is a plurality of gas enclosures 17. In FIG. 3, the gas enclosures 17 are shown as frustoconical shells 41, but other gas enclosures 17, such as a tube with a spiral insert or a gas coil, may be used. Additionally, each gas enclosure 17 may be different. For example, the first gas enclosure may be a gas coil and the second may include a frustoconical shell.

FIG. 6*a* shows an arrangement in which the gas enclosures 17 are all provided in a single thermally insulated chamber 15. Three heat sources 51 are shown, although any number of heat source 51 can provided (even a single heat source). The heat sources 51 heat the inside of the thermally insulated chamber 15, and thereby also heat the gas enclosures 15.

Gas enters the input of the first gas enclosure, and follows a spiral or helical gas path around an axis of that first gas enclosure before exiting the first gas enclosure. The input of the second gas enclosure is connected to the output of the first gas enclosure. The gas then follows a second spiral or helical gas path in the second heated enclosure. The output of the second enclosure, in FIGS. 6*a* and 6*b*, is connected to the input of the third gas enclosure, in which the gas follows a third spiral or helical path.

Providing multiple gas enclosures (heated enclosures) 17 allows the dwell time for the gas to be increased. For example, the dwell time in the first gas enclosure 17 may be 2 seconds. If the other gas enclosures are the same as the first gas enclosure, the dwell time will be 2 seconds multiplied by the number of gas enclosures (heated enclosures). Accordingly, there is a greater chance of cracking (pyrolysing or gasifying) hydrocarbons in the gas.

The arrangement of FIG. 6*b* comprises three units, each including a gas enclosure 17, a thermally insulated chamber 15 and a heat source 51. The arrangement of FIG. 6*b* may be, for example, the heating system of an ATT apparatus, wherein each unit is a heating unit of that ATT apparatus. It will be appreciated that more heat source 51*s* can be provided for each chamber as appropriate. Further, more than three units may be provided, or two units may be provided.

As each gas enclosure 17 of FIG. 6*b* has an associated thermally insulated housing, and heat source 51, the temperature of each of the gas enclosures can be more carefully controlled.

As the residual hydrocarbons that remain in the within the gaseous mixture after the first heated enclosure are likely to be more difficult to break down, more energy (higher temperatures) will be useful in the second heated enclosure. Accordingly, in some aspects, the gaseous mixture first enters the heated enclosure of the coolest heating unit, and is then directed to the heated enclosure of the second coolest heating unit, and so forth until the gaseous mixture reaches the heated enclosure of the hottest heating unit.

In some aspects, two (or more) consecutive gas enclosures 17 may be at the same temperature to increase the dwell time. This provides an increased dwell time at a temperature hot enough for a pyrolysis process to occur. Any particulates (hydrocarbons) that remain after that extended dwell time may be subjected to a relatively high temperature in a later gaseous enclosure. In an example, the first and second gas enclosures may be at 1250° C. whereas the third gas enclosure may be at 1500° C.

Having the temperature of the gas enclosure increase from the first to the last gas enclosure provides a more efficient system, as the highest temperatures are provided to the final gas enclosure in which a higher proportion of hydrocarbons remaining in the gas will be difficult to break down.

Preferred Arrangement in an Advanced Thermal Treatment Apparatus

Figure 7:
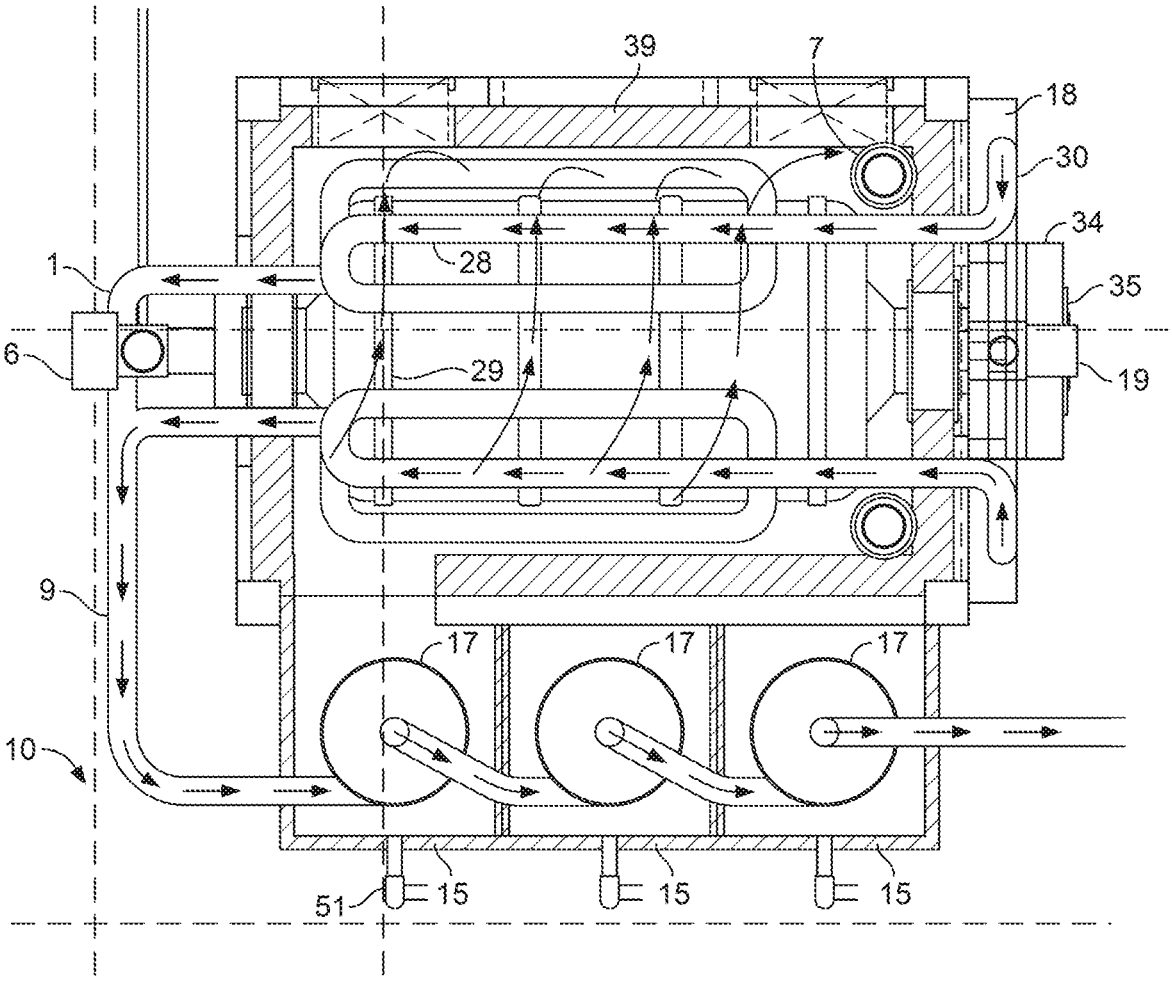
FIG. 7 shows a plan view of an Advance Thermal Treatment (pyrolysis or gasification) apparatus including a series of gas enclosures according to the preferred embodiment.
Figure 8:
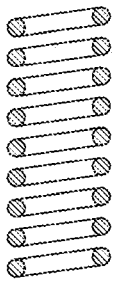
FIG. 8 shows a gas coil.

FIGS. 1 and 7 show an ATT apparatus incorporating gas enclosures (heated enclosures) 17 containing a helical gas path. That ATT apparatus includes both a frutoconical shell 41 within a heating unit and a heated tube having a spiral insert. It will be appreciated, however, that other embodiments may omit the frustoconical shell 41 within a heating unit or the heated tube having a spiral insert. A preferred ATT apparatus is described below.

Figure 2:
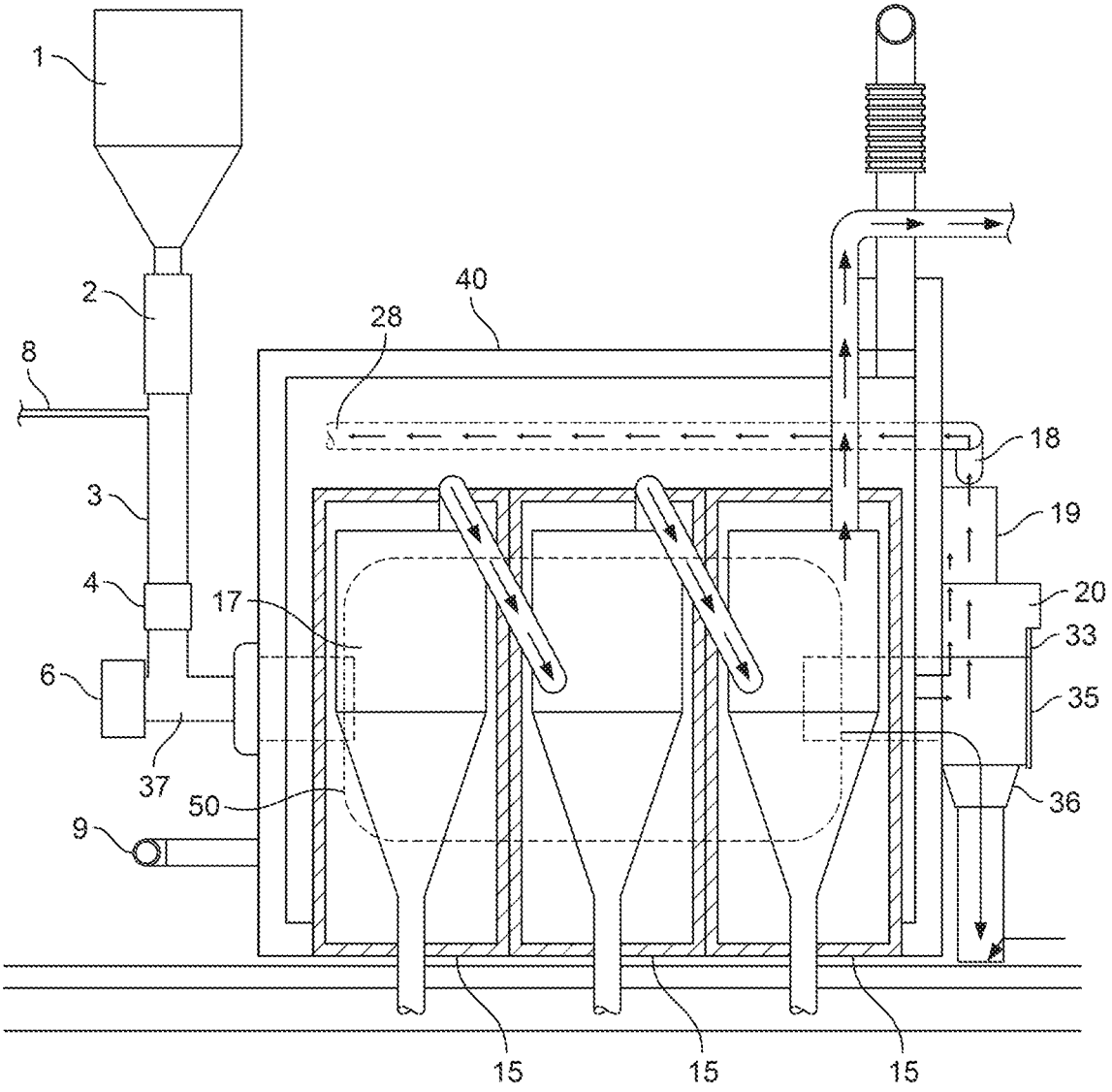
FIG. 2 is a section side elevation of a pyrolysis apparatus according to that embodiment.

With reference to FIGS. 1, 2 and 7, the Advanced Thermal Treatment apparatus includes a retort feed 1 to allow feedstock to enter an ATT unit 50. The ATT unit 50 in FIGS. 1 and 2 is shown as a cylindrical retort (or 'kiln') 50, however, any ATT unit 50 having a pyrolysis region can be used. For example, in the retort 50 shown in FIGS. 1 and 2, a burner 51 directs heated air toward the surface of the retort 50, thereby creating a pyrolysis region in the retort as the temperature of the retort surface rises.

The retort feed 1 is shaped to direct feedstock into a substantially vertical feed pipe 3. One or more airlocks 4 can be provided in the feed pipe 3, below the retort feed 1, to prevent air entering the ATT retort. The one or more airlocks 4 may be arranged to maintain a positive pressure inside the feed pipe 3, thereby preventing air entering the feed pipe 3.

The feed pipe 3 may include a $CO_2$ feed supply 8, to allow $CO_2$ to enter the feed pipe 3. Where two airlocks are provided, the $CO_2$ may enter the feed pipe 3 between the two airlocks. Further airlocks may be provided in addition to the two airlocks. The bottom of the feed pipe 3 is connected to a substantially horizontal pipe 27 for transporting the feedstock toward the ATT retort 50.

In some aspects, the horizontal pipe includes an auger 37 for transporting the feedstock to the retort 50. The auger 37 may be constructed from nickel alloy and is driven by a motor 6. In some aspects, the diameter of the auger 37 is 12 inches (0.3 m).

A portion of the substantially horizontal pipe 27 may be located within the retort 50. The portion located within the retort 50 may have a perforated section to allow feedstock to exit the pipe 27 through the perforations, thereby dispersing the feedstock over a wider area within the retort 50. Alternatively, the feedstock can exit the substantially horizontal pipe 27 via an exit end of the substantially horizontal pipe 27. Preferably, the retort 50 is coaxial with the feed pipe 3, and the retort is rotable about the common axis. The rotating action of the retort 50 helps to mechanically break down the feedstock, therefore exposing a larger surface area of the feedstock to the heated atmosphere within the retort 50. In this manner, feedstock can be processed more efficiently.

Within the retort 50, the feedstock undergoes an Advanced Thermal Treatment (ATT) process (i.e. a pyrolysis or gasification process). The one or more airlocks prevent, or substantially prevent, air and other ambient gases from entering the retort 50. Accordingly, the first ATT process may be considered a pure pyrolysis process.

Referring again to FIGS. 1 and 7, the retort 50 (retort or kiln in FIGS. 1 and 7) is located within a thermally insulated retort housing 40. The atmosphere within the retort 50 is isolated from the atmosphere that is inside the retort housing 40 but external to the retort 50. The retort 50 is heated to a temperature sufficient for a first ATT process to occur.

In the first ATT process, the feedstock within the retort 50 is converted into a gaseous mixture, comprising syngas, and char. Due to inefficiencies in the process, such as insufficient temperature or dwell time being applied to the feedstock, the gaseous mixture also includes residual particulates such as oil and tar particles, and PAHs. Conventionally, therefore, the gas produced by an ATT unit 50 would need to be scrubbed (cleaned) before use. In the preferred embodiment, the gas from the ATT unit 50 is directed through one or more heated enclosures, in which the gas follows a helical gas path.

In the preferred arrangement, the first gas enclosure (heated enclosure) is located within the insulated housing 40 and is therefore heated by the same heating system 52 as the retort 50. The first gas enclosure is a tube 48 with a spiral insert 49, the tube 48 having a narrower diameter than the retort 50. For example, the tube 48 may be part of the system of piping 28 that connects the retort 29 to a second heated enclosure 41 within the heating system 52.

Due to the narrower diameter, heat transfer to the middle of the tube 48 by radiation and convection will be greater than heat transfer to the middle of the retort. Accordingly, the average temperature within the tube 48 will be higher than the average temperature of the retort 50. Additionally, due to the centrifugal force that results from the helical gas path, particles within the gaseous mixture are impelled toward the wall of the tube 48. A second ATT process, which includes conductive heating for heavier particles, takes place within the tube 48.

In the preferred embodiment, the second heated enclosure is located downstream of the tube 48. The second heated enclosure is shown in FIG. 1 as a frustoconical shell 41 having an extension portion 46. The gas enters the extension portion 46, above the frustoconical shell 41, at an oblique angle (i.e. at an angle inclined to the radius of the frustoconical shell), resulting in a helical path for the gaseous mixture. In the preferred embodiment, the frustoconical shell 41 is located within a thermally insulated chamber 15 of the heating system 52.

In some aspects, one or more heat sources 51 may heat the inside of the thermally insulated housing 15. In other aspects, a heating system 52 comprises a plurality of heating units as described earlier. Each heating unit comprises a thermally insulated housing 15 and a heat source 51. A heating system 52 of the preferred embodiment includes a plurality of heating units that comprise frustoconical shells 41.

As shown in FIGS. 1 and 3, the thermally insulated chamber 15 includes an exit aperture through one wall. Preferably, the one wall is opposite the heat source 51 such that air heated by the heat source 51 can exit the thermally insulated chamber 15 via the exit aperture. When deployed as part of an ATT apparatus, the exit aperture is arranged so as to direct heated air from the heat source 51 onto an ATT unit (retort) 50. For example, gas heated by the heat source 51 can exit the thermally insulated chamber 15 through the exit aperture and thereafter heat the ATT unit 50. In the arrangement shown in FIG. 1, the exit aperture leads to the inside of the thermally insulated housing 40. The exit aperture may lead directly to the inside of the thermally insulated housing 40, as shown in FIG. 1, or may lead to an insulated passageway, which then leads to the inside of the thermally insulated housing 40. The insulated passageway may be of any cross-section, such as a square cross-section or a circular cross-section.

In the arrangement shown in FIGS. 1 and 3, the heat source 51 is a burner and is located outside the thermally insulated chamber 15. A duct, which penetrates the thermally insulated chamber 15 connects the burner 51 to the thermally insulated chamber 15 so as to provide heated air into the thermally insulated chamber 15. The thermally insulated chamber 15 is sealed around the duct in the arrangement of FIGS. 1 and 3.

FIGS. 1 and 2 shows an arrangement in which the gas enclosure (heated enclosure) 17 includes a frustoconical shell 41, but it will be appreciated that other heated enclosures 17 in which gas follows a helical path are contemplated. It is preferred that the heated enclosure 17 is positioned in the path of the heated air from the burner 51. The heated enclosure 17 is therefore positioned in one of the hottest locations within the ATT system, thereby improving the chance of breaking down any residual particulates in the gaseous mixture within the gas enclosure 17.

In some aspects, the heating system 52 comprises a plurality of heating units. Preferably, the heating units are spaced along the length of the ATT unit. The heating units may be at different temperatures. In the preferred embodiment, the heating unit nearest the feedstock input hopper 1 is the hottest. As the feedstock is the coldest on entry into the retort 50, the retort 50 will be coldest near the feedstock input hopper 1. Accordingly, it is advantageous to locate the hottest heating unit proximate the feedstock input hopper end of the retort 50 in order to minimise any potential temperature gradient along the length of the retort 50.

Where a heating system 52 comprises a plurality of heating units, the gaseous mixture may exit the heated enclosure located within a first heating unit, and be directed to a heated enclosure located within a second heating unit, and so forth.

The amount of residual particles (oils, tars and PAHs) within the gaseous mixture will reduce at each gas enclosure 17 at least due to the additional dwell time. Additionally, where multiple heating units are provided, the gas enclosures 17 may be at different temperatures, allowing cracking of hydrocarbons within the gaseous enclosures to be controlled.

As shown in FIG. 7, the gaseous mixture first enters a gas enclosure 17 within a first heating unit located furthest from the feedstock input end of the ATT unit 50, before being directed to another gas enclosure 17 within a second heating unit located closer to the feedstock input end of the ATT unit 50. Finally, the gaseous mixture is directed toward the gas enclosure within the third heating unit closest to the feedstock input end of the ATT unit 50. The gas enclosure 17 in each of the first to third heating units has a 2 second dwell time in the preferred embodiment. However, other gas enclosures may be used that have different dwell times.

The temperature of the gas enclosures (heated enclosures) 17 within the first two heating units is between 1100° C. and 1300° C. The temperature of the gas enclosure (heated enclosure) 17 within the third heating unit (closest to the feedstock input end of the ATT unit) is between 1300° C. and 1600° C. To account for the temperature, the heated enclosure within the third heating unit is made of Titanium or a Titanium-alloy, whereas the heated enclosures within the first and second heating units maybe a cheaper material such as Nickel or a Nickel-alloy.

OTHER ASPECTS, EMBODIMENTS AND MODIFICATIONS

In the preceding embodiments, a cylindrical rotating retort has been described. However, in other embodiments, different shapes could be adopted. For example, the cross-section does not need to be constant along the entire length of the retort it could flare or narrow downwards.

Likewise, whilst a circular cross-section is convenient to manufacture, non-circular cross-sections could be used; an elliptical cross-section increases the dwell time on some parts of the retort which may be useful in some cases. Many other cross-sections could be used, though sharp corners might tend to trap material. The rotation employed might likewise be provided using elliptical gears or other means to vary the rotational speed within each rotation, so as to control the dwell time on different sectors of the retort.

Whilst rotation, unidirectional or bidirectional, has been described, it would be possible to turn the retort through less than an entire turn before reversing it in other words, to apply a rotational oscillation. In this case, the retort does not need to be enclosed but could be a concave, for example semicircular, surface.

Other aspects which might be used with the present invention are described in our co-pending applications incorporated in their entirety by reference, filed the same day as the priority application for the present application GB1503760.9, and with the following titles and application numbers:

GB1503766.6 "Pyrolysis Methods and Apparatus"
GB1503765.8 "Pyrolysis Retort Methods and Apparatus"
GB1503772.4 "Temperature Profile in an Advanced Thermal Treatment Apparatus and Method"
GB1503770.8 "Advanced Thermal Treatment Apparatus"
GB1503769.0 "Advanced Thermal Treatment Methods and Apparatus"

A person skilled in the art would understand that various types of heat source and fuels therefor could be used, in addition to those described above and in the co-pending applications mentioned above.

Many other variants and embodiments will be apparent to the skilled reader, all of which are intended to fall within the scope of the invention whether or not covered by the claims as filed. Protection is sought for any and all novel subject matter and combinations thereof disclosed herein.

The invention claimed is:

1. A pyrolysis apparatus, comprising a pyrolysis unit having a pyrolysis region and a gas exit passage;

a first gas enclosure in fluid communication with the gas exit passage of the pyrolysis unit, wherein the first gas enclosure includes a frustoconical shell having a gas input pipe connected thereto, the gas input pipe being inclined at a radius of the first gas enclosure, and wherein a gas path within the first gas enclosure is helical; and a heating system adapted to heat the first gas enclosure to a temperature sufficient for the gaseous mixture to undergo a pyrolysis process.

2. The pyrolysis apparatus of claim 1, wherein the first gas enclosure includes an extension portion having parallel, or substantially parallel, walls extending from a widest circumference of the frustoconical shell.

3. The pyrolysis apparatus of claim 1, wherein the first gas enclosure is located within the heating system.

4. The pyrolysis apparatus of claim 1, further comprising a second gas enclosure having an input, and a helical gas path and a gas output of the first gas enclosure is in fluid communication with a gas input of the second gas enclosure.

5. The pyrolysis apparatus of claim 1 wherein the heating system comprises a thermally insulated chamber and one or more heat sources arranged to heat the inside of the thermally insulated chamber.

6. The pyrolysis apparatus of claim 5, wherein the first gas enclosure is within the thermally insulated chamber.

7. The pyrolysis apparatus of claim 6, wherein the thermally insulated chamber has an exit aperture through one wall, and the first gas enclosure is positioned between the heat source and the exit aperture.

8. The pyrolysis apparatus of claim 1, wherein the heating system is adapted to heat an exterior surface of the first gas enclosure.

9. The pyrolysis apparatus of claim 1, wherein the heating system comprises a plurality of heating units, wherein each heating unit comprises a thermally insulated chamber and a heat source arranged to heat the inside of the thermally insulated chamber.

10. A pyrolysis apparatus comprising:

a pyrolysis unit having a pyrolysis region and a gas exit passage;

a first gas enclosure in fluid communication with the gas exit passage of the pyrolysis unit, wherein the first gas enclosure includes a frustoconical shell having a gas input pipe connected thereto, and wherein the first gas enclosure receives a gaseous mixture that exits the gas exit passage; and a heating system adapted to heat the first gas enclosure to a temperature sufficient for the gaseous mixture to undergo a pyrolysis process.

11. The pyrolysis apparatus of claim 10, wherein the gas input pipe is inclined at a radius of the first gas enclosure, and wherein the gas enclosure is a pipe having a spiral insert and wherein a gas path within the first gas enclosure is helical.

12. The pyrolysis apparatus of claim 11, wherein the spiral insert is fixedly attached to an inner surface of the pipe.

13. The pyrolysis apparatus of claim 10, wherein the first gas enclosure is located within the heating system.

14. The pyrolysis apparatus of claim 10, further comprising a second gas enclosure, wherein a gas path within the second gas-enclosure is helical and a gas output of the first gas enclosure is in fluid communication with a gas input of the second gas enclosure.

15. The pyrolysis apparatus of claim 10, wherein the heating system comprises a thermally insulated chamber and one or more heat sources arranged to heat the inside of the thermally insulated chamber, wherein the first gas enclosure is within the thermally, insulated chamber, and wherein the thermally insulated chamber has an exit aperture through one wall, and the first gas enclosure is positioned between the heat source and the exit aperture.

16. The pyrolysis apparatus of claim 10, wherein the heating system is adapted to heat an exterior surface of the first gas enclosure.

* * * * *